US007653971B2

(12) United States Patent
Cory

(10) Patent No.: US 7,653,971 B2
(45) Date of Patent: Feb. 2, 2010

(54) COTTON CONDITIONING DEVICE

(75) Inventor: Mark D. Cory, Fortson, GA (US)

(73) Assignee: Cherokee Fabrication Co., Ltd., Salem, AL (US)

( * ) Notice: Subject to any disclaimer, the term of this patent is extended or adjusted under 35 U.S.C. 154(b) by 658 days.

(21) Appl. No.: 11/481,994

(22) Filed: Jul. 6, 2006

(65) Prior Publication Data

US 2008/0005869 A1 Jan. 10, 2008

(51) Int. Cl.
*D01B 1/00* (2006.01)

(52) U.S. Cl. ..... 19/66 CC

(58) Field of Classification Search ..... 19/66 CC, 19/48 R, 39, 66 R, 200, 308
See application file for complete search history.

(56) References Cited

U.S. PATENT DOCUMENTS 4,103,397 A 8/1978 Jackson
4,140,503 A 2/1979 Vandergriff
4,999,881 A 3/1991 Vandergriff et al.
5,155,886 A 10/1992 Schrader et al.
5,199,133 A 4/1993 Burton
5,381,587 A 1/1995 Vandergriff
6,314,618 B1 11/2001 Mehner et al.
6,698,066 B2 3/2004 Latham

*Primary Examiner*—Tejash Patel
(74) *Attorney, Agent, or Firm*—Miller & Martin PLLC

(57) ABSTRACT

The present invention related generally to a device for adding moisture to fibrous material such as cotton. The conditioning device receives a continuous cotton batt from a battery condenser. The continuous cotton batt is fed between two opposing drums. Hot moist air is fed into one drum and drawn out of the perforated surface of the drum, through the batt as it is being compressed between the two drums, and into the other drum. The opposing drums are internally compartmented by a plurality of longitudinal staves, each compartment being covered by a corresponding segment of the perforated surface. Hot dry air is fed into the compartments of the drums when the corresponding segment of the surface is not carrying the cotton batt in order to dry the surface of the drum and clear the perforations of any lint that might have been retained on the surface.

36 Claims, 4 Drawing Sheets

COTTON CONDITIONING DEVICE

FIELD OF THE INVENTION

This invention relates in general to processing fibrous materials, and in particular to a device for humidifying lint cotton and other fibrous materials and compressing the material to increase its density.

The present invention relates generally to a cotton conditioning device for adding moisture to lint cotton prior to the baling process. The device can be used with any existing cotton gin battery condenser. The device can be used as an attachment to receive a cotton batt from any existing battery condenser by attaching it intermediate the battery condenser and a slide configured to receive the humidified and compressed batt from the conditioning device. The device humidifies lint cotton by receiving a batt of lint cotton and compressing it at a nip point between two opposing, counter-rotating drums housed side-by-side with one drum being slightly elevated relative to the other. As the cotton lint is compressed between the two opposing drums, moist hot air is injected into one drum, through the perforated surface of the drum, through the batt being compressed and is drawn into the second drum.

Hot dry air is fed into the compartments of the drums when the corresponding segment of the surface is not carrying the cotton batt in order to keep dry the surface of the drums and clear the perforations of any lint that might have been retained on the surface.

DESCRIPTION OF RELATED ART

It is well recognized that humidifying cotton lint prior to baling aids with the baling process by reducing the forces required to compress the bale. Also, there are multiple reasons that correct moisture levels are desirable for the spinning mills that use these bales. For example, cotton fibers with too low of a moisture content become brittle and are prone to breakage. There are currently four widely-used methods to add moisture to a cotton batt prior to baling. One common method, falling out of favor for its poor results, is simply to set up an atomized mister above the slide that moves the cotton batt to the baler, spraying water directly onto the surface of the cotton. The thicker the batt, the less desirable this method becomes. The moisture does not tend to migrate through the batt evenly, resulting in alternating layers of wet and dry cotton in the finished bales. When moisture is added in this way, it is very easy to add too much water to a bale, thus making it prone to damage from rotting. This method can also be deceitful since excess water weight can easily be added to a bale (cotton being sold by weight). Even if the right amount of moisture is added per unit volume of cotton, it is only useful if it is fairly evenly distributed throughout the bale. When a spray system is used on a thick batt, the layering effect described above can potentially create micro layers of moisture-damaged cotton and good cotton throughout a bale, thus rendering the entire bale useless.

A second method is described in U.S. Pat. No. 4,103,397, entitled "Lint Slide Grid Humidifier." The device of this patent registration consists of a perforated lint slide which receives a batt of cotton from a battery condenser. As the batt is moved along the slide, hot moist air is allowed to slowly rise up through the bat along most of the length of the lint slide. Although this system is effective, it is inefficient because the rate of moisturization of the device cannot keep up with current capacity requirements. The capacity of a slide grid humidifier can be increased by adding length to the slide, but it is impractical to elongate slides further due to factory building height limitations. Furthermore, current batts are thicker than batts produced in the past and it is difficult to pass humid air through them uniformly by applying only a positive pressure on one side, resulting in an uneven distribution of moisture throughout the batt.

Another common method of humidifying lint cotton is shown in a variety of patents by A. L. Vandergriff. U.S. Pat. No.(s) 4,140,503, 4,999,881 and 5,381,587 are different versions of a cotton lint humidifying device having a drum with separated segments. U.S. Pat. No. 4,140,503 teaches a device which raises the moisture level of the cotton lint by passing it between sealing rollers. Moist or humid air is then supplied to the condenser chambers, raising the cotton lint to the desired moisture level.

Similarly, U.S. Pat. No. 4,999,881 uses a system of air chambers and conduits which transport dry heated air to certain metal surfaces within the condenser unit, increasing the temperature of surfaces and avoiding moisture build up as a means of condensate control.

U.S. Pat. No. 5,381,587 teaches a cotton gin lint condenser which rotates the batt through different segments of the housing. The housing has a lint inlet segment, a segment for adding moisture to the batt by passing it through warm humid air, a segment for doffing the batt from the drum, and a segment for removing moisture from the drum by rotating it through dry air. The warm dry air also warms the lint slide surface.

Another way to add moisture to cotton lint is taught in U.S. Pat. No. 6,314,618 entitled "Moisture Conditioner for Lint Cotton." This device is different from prior devices because the steam roller is not a part of the cotton gin battery condenser but rather an add-on the device. The steam roller device may be incorporated at the top of the slide after the battery condenser. A continuous batt of cotton is passed between a stationary screen and a rotatable cylinder having a perforated surface. Hot humidified air is passed through the screen and batt, and is drawn into the cylinder.

SUMMARY OF THE INVENTION

It is an object of the present invention to provide a cotton conditioning device for adding moisture to lint cotton during the baling process.

Another object of the present invention is to provide a cotton conditioning device that further compresses the continuous cotton batt received from a battery condenser.

A further object of the present invention is to provide a cotton conditioning device which can be used with any existing cotton gin battery condenser.

Another object of the present invention is to provide a device which effectively and efficiently adds moisture to lint cotton during the baling process.

Another object of the present invention is to provide a cotton conditioning device which can be manufactured and sold at a reasonable price and added to existing cotton processing lines.

Accordingly, a presently preferred embodiment of the present invention provides a cotton gin conditioning device for adding moisture to lint cotton prior to the baling process. The conditioning device receives a continuous cotton batt from a cotton gin battery condenser that is fed between two opposing, counter-rotating drums. Hot moist air is drawn from a source into one drum and forced or drawn out of the perforated surface of the drum, through the batt as it is being compressed between the two drums, and into the other drum. The opposing drums are internally compartmented by a plurality of longitudinal staves, each compartment being covered by a corresponding segment of the perforated surface. Hot dry air is fed or drawn into the compartments of the drums when the corresponding segment of the surface is not carrying the cotton batt in order to dry the surface of the drum and clear the perforations of any lint that might have been retained on the surface.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
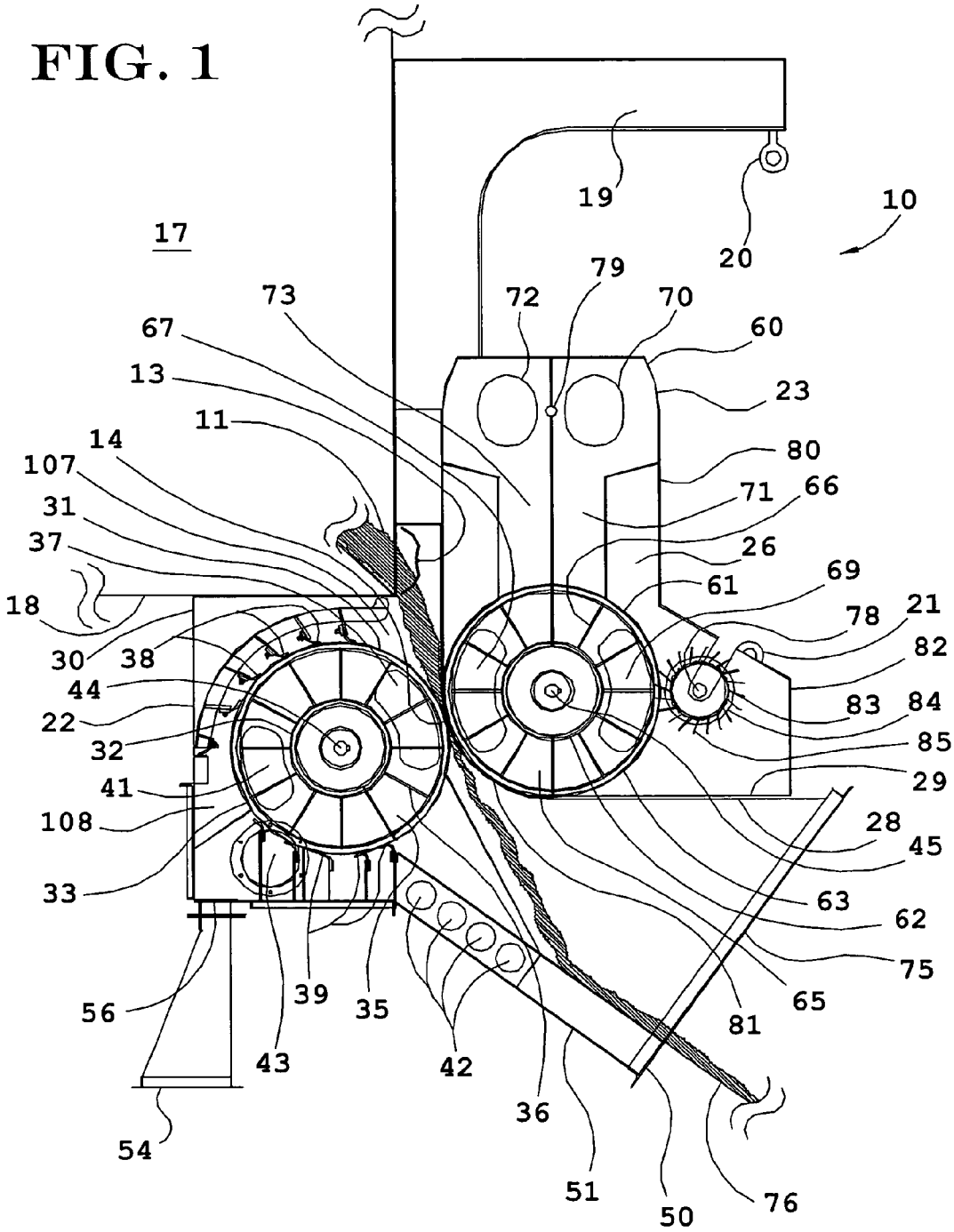
FIG. 1 is a side schematic view of the cotton conditioning device of the present invention.

As illustrated in a schematic side view in FIG. 1, this invention teaches a cotton conditioning device 10 for adding moisture to cotton lint prior to the baling process. The cotton conditioning device 10 of the present invention consists of a stationary unit 30 and a suspended unit 60 positioned in mating contact with the stationary unit 30 along mating surfaces 28 and 29, respectively.

Figure 3:
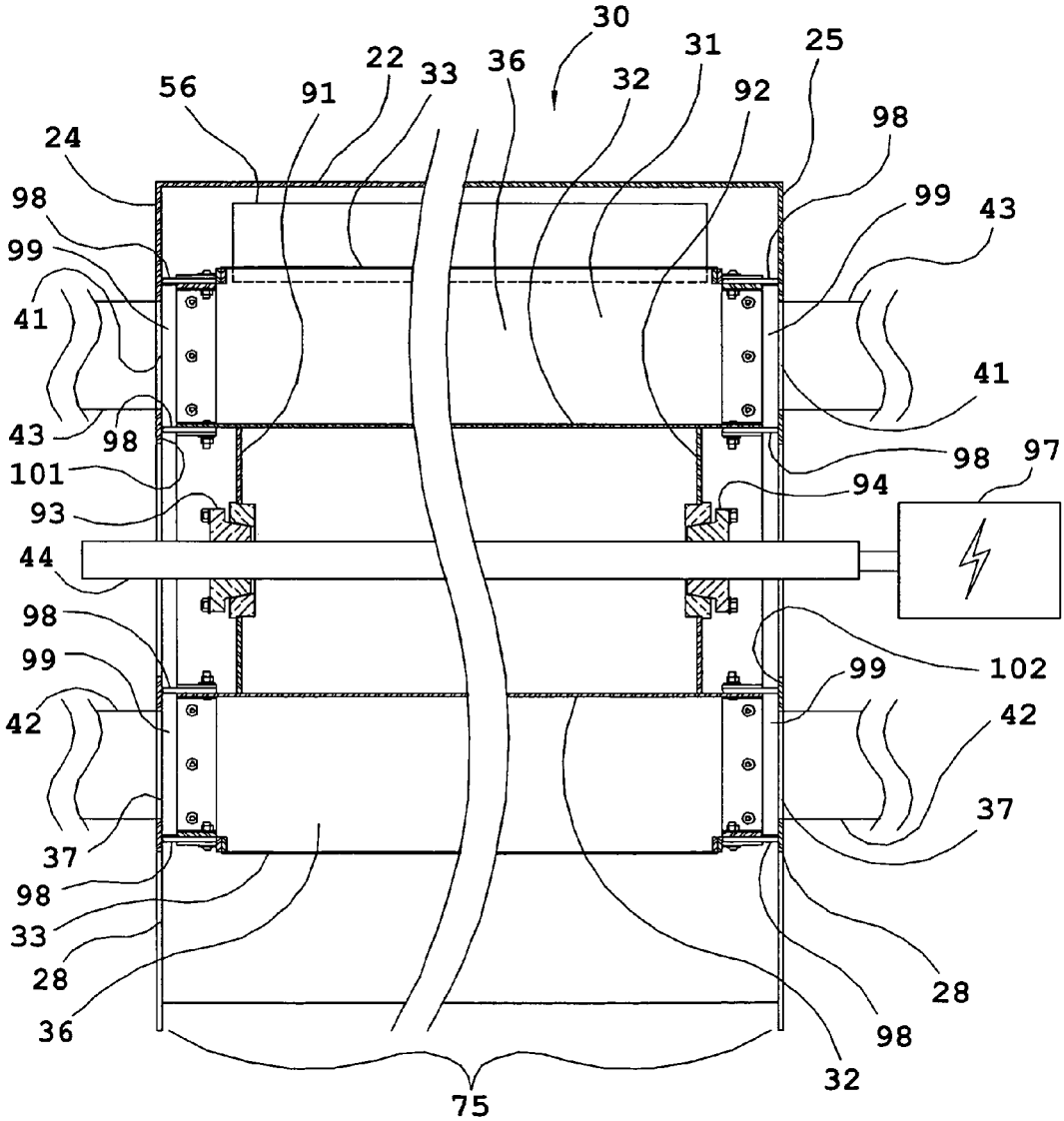
FIG. 3 is a top longitudinal cross section view of a stationary unit of the present invention wherein the cross section is shown through the center plane of the rotatable lower drum.

As best shown in FIG. 3, the stationary unit 30 comprises a housing 22 containing a cylindrical, rotatable lower drum 31 on an axial shaft 44 running through a first side 24 of the housing 22 and a first opposing end of the drum 31, to a second opposing end of the drum 31 and an opposing second side 25 of the housing 22. The opposing ends of the drum 31 are substantially covered or capped by the solid, non-permeable first and second sides 24, 25 of the housing 22 which remain stationary as the drum 31 rotates. Each first and second side 24, 25 of the housing 22 further comprise a mating surface 28 shaped to correspond to the mating surfaces 29 of the suspended unit 60 (as shown in FIG. 1).

Returning to FIG. 1, the housing 22 generally defines an enclosure for the lower drum 31 that is substantially open between the mating surfaces 28 and further defines an opening 13 for receiving a continuous batt 11. The opening in the housing 22 between the mating surfaces 28 and the opening for receiving a continuous batt 11 may be the same or separate openings.

Preferably, the stationary unit 30 is attached adjacent to the batt output opening 13 of a battery condenser 17 such that the continuous batt 11 is fed from the battery condenser 17 onto the lower drum 31 or the upper drum 61 proximate to the nip point or gap 14 between the lower drum 31 and the adjacent upper drum 61. Again, as best shown in FIG. 3, the stationary unit 30 further comprises an output opening 75 between the first and second sides 24, 25 of the housing 22 through which the compressed and humidified batt 11 advances after conditioning. Preferably, the output opening 75 is directly connected to the top of the lint slide 76 (shown in FIG. 1) over which it will travel to the baler.

As shown in FIG. 1, the suspended unit 60 comprises a housing 23 containing a cylindrical, rotatable upper drum 61 on an axial shaft 45 running through a first side 26 of the housing 23 and a first opposing end of the drum 61, to a second opposing end of the drum 61 and an opposing second side 27 (not shown in FIG. 1) of the housing 23. The opposing ends of the drum 61 are substantially covered or capped by the solid, non-permeable first and second sides 26, 27 of the housing 23 which remain stationary as the drum 31 rotates. Each first 26 and second side 27 of the housing 23 also have a mating surface 29 shaped to correspond to the mating surfaces 28 of the stationary unit 30. The housing 23 of the suspended unit 60 is generally shaped like a boot, with a rounded heel portion 81, a toe portion 82 and a leg portion 80, but is open between the mating surfaces 29.

The upper drum 61 is located within the heel portion 81 of the suspended unit 60 and, as shown, the curvature of mating surfaces 29 substantially follows the curvature of the exterior surface 63 of the upper drum 61.

The toe portion 82 of the suspended unit 60 houses a powered, rotatable doffing roller 83 on a shaft 78 running from the first and second sides 26, 27 of housing 23 that is substantially parallel to shaft 45 of the upper drum 61. Shaft 78 is adjustibly positionable on the first and second sides 26, 27 of the housing 23 such that the distance between the doffing roller 83 and the upper drum 61 may be varied by the user. The doffing roller 83 functions to remove any lint that accumulates on the perforated stainless steel exterior surface 63 of the upper drum 61. A plurality of replaceable flashings 85 extend from the exterior 84 of the doffing roller 83 along its longitudinal axis. The doffing roller 83 is rotated in the same direction as the upper drum 61 so that the flashings 85 of the doffing roller 83 sweep against the exterior surface 63 of the upper drum 61, thereby removing any lint that may have accumulated on the upper drum 61. As the flashings 85 are worn away from friction with the perforated surface 63 of the drum 61, the doffing roller 83 can be positioned nearer to the upper drum 61 so as to remain effective until the flashings 85 must be replaced. Preferably, the doffing roller 83 runs at a perimeter speed (or surface speed) slightly faster than the upper drum 61 such that in the event any excess lint is carried around on the surface 63 of the upper drum 61 after the batt would normally have been expected to have separated from the drum 61, the excess lint would be brushed off and thrown down to the lint slide 76 by the doffing roller 83.

The suspended unit 60 is suspended from a laterally transverse shaft 79 located toward the top of leg portion 80 of the housing 23. The shaft 79 is axially aligned with the upper drum 61. When suspended from shaft 79, the mating surfaces 29 of the suspended unit 61 contact or rest upon the mating surfaces 28 of the stationary unit 30.

The lower drum 31 and the upper drum 61 are positioned within their respective housings 22, 23 to form a nip point 14 between the exterior surface 33 of the lower drum 31 and the exterior surface 63 of the upper drum 61. At the nip point 14, when the mating surfaces 28, 29 of the housings 22, 23 are in mated position, the surfaces 33, 63 of the upper and lower drums 61, 31 face each other across a gap that is preferably about one quarter inch (0.63 cm) apart, but not more than about one inch (2.54 cm) apart, to facilitate the intake of the batt 11. In a preferred embodiment, the upper drum 61 is positioned slightly above the lower drum 31 as illustrated in FIG. 1 in order to maintain the directional path of the batt 11 that existed prior to its introduction into the conditioning device 10.

As a continuous batt 11 is fed into the nip point 14, the drums 31, 61 rotate in opposite directions away from the battery condenser 17. Friction of the batt 11 with the texturized, perforated exterior surfaces 33, 63 of the rotating drums 31, 61 at and about the nip point 14 serves to continually advance the batt 11 through the conditioning device 10. A continuous batt 11 exiting a battery condenser 17 is typically four to fifteen inches thick and is compressed as it traverses the nip point 14. The perimeter speed (or surface speed) of drums 31, 61 are set at approximately the same perimeter speed of the battery condenser drum (not shown) to prevent breakage of the batt.

The shaft 79 acts as a pivot point for the suspended unit 60 and upper drum 61, allowing the suspended unit 60 and upper drum 61 to be pushed away from the stationary unit 30 and lower drum 31 as a batt 11 passes between the lower drum 31 and the upper drum 61. Even though it is pivotedly engaged against the stationary unit 30, the weight of the suspended unit 60 will generally provide sufficient compressive force to the batt 11 at the nip point 14 so that the suspended unit 60 does not pivot, or pivots only nominally (generally less than 6 to 8 inches) during the ordinary course of operation. In order to ensure that the proper amount of compression is achieved, one or more pneumatic pistons (not shown) may be attached to the toe portion of the housing 23, thereby providing a means for controlling movement of the suspended unit 60 and its drum 61 relative to the stationary unit 30 and its drum 31. In order to facilitate cleaning of the conditioning device 10, it has been found that it is preferable to provide a leverage point above the suspended unit 60, such as arm 19 and eyelet 20. Using the leverage point and a hook or loop 21 on the toe portion of the housing 23, a cable or chain (not shown) can be connected to winch the suspended unit 60 away from the stationary unit 30 for easy access, such as for cleaning.

FIG. 3 illustrates the internal configuration, placement and connection of the lower drum 31 within the housing 22 of the stationary unit 30. However, except for differences in the shape of the housing 23 of the suspended unit 60, the internal configuration and attachment of the upper drum 61 within the housing 23 of the suspended unit 60 substantially mirror that of the lower drum 61 illustrated in FIG. 3. The lower drum 31 comprises an axial central core 32 through which the drum shaft 44 runs. The core 32 is connected to the shaft 44 by collars 93, 94 towards either opposing end 91, 92 of the drum 31 The shaft 44 extends through the first side 24 and second side 25 of the housing. The shaft 44 is operationally connected, such as through a gear box (not shown) to a motor means (shown schematically as 97) for powering and controlling the rotational speed of the drum 31.

The exterior surface 33 of drum 31 comprises a perforated surface having a multiplicity of perforations, preferably distributed uniformly about the entire surface 33, which is preferably stainless steel. The exterior surface 63 of upper drum 61 is similarly perforated. Preferably the exterior surfaces 33, 63 are not smooth, but rather has a slight texture to assist in carrying the cotton lint batt 11 along with the rotation of the drum 31, 61. Finally, in one embodiment, the exterior perforated surfaces 33, 63 of the drums 31, 61 comprise a removable perforated stainless steel sheath attached to the staves 36, 66 so that it can be removed for cleaning or replacement.

As best shown in FIG. 1, the exterior surfaces 33, 63 of both drums 31, 61 are separated from their respective cores 32, 62 by a plurality of radial staves 36, 66, preferably twelve staves, extending from the cores 32, 62 to the exterior surface 33, 63. Staves 36, 66 are substantially the same length as the cores 32, 62 and divide the interior of the drums 31, 61 into a plurality of open-ended radial compartments 35, 65 running along the longitudinal axis of the drum 31, 61. Compartments 35, 65 are bounded interiorly by a segment of the core 32, 62, on either side by staves 36, 66 and exteriorly by a segment of the perforated surface 33, 63. As explained in more detail below, the compartments 35, 65 function in separating air flow inside the drums 31, 61.

As shown in FIG. 3, the opposing ends 91, 92 of drum 31 have a plurality of replaceable gaskets 98, 99 to provide a seal against the inner faces 101, 102 of the first and second sides 24, 25 of the housing 22. Specifically, replaceable gaskets 98 or 99 are attached to the opposing ends of the core 32, the opposing ends of the external surface 33 and each of the plurality of staves 36. Upper drum 61 is gasketed in an identical manner.

At least one of, but preferably both the first and second sides 24, 25 of the housing 22 are pierced by an anterior passage 37 and a posterior passage 41. The anterior passage 37 is shaped to open into the lower drum 31 between the core 32 and the exterior surface 33 about and before the nip point 14 (not shown in FIG. 3), i.e., on the anterior side of the drum 31. In other words, the anterior passage 37 is positioned to open into compartments 35 of the drum that are in close proximity to the nip point 14, preferably with more of the anterior passage 37 located proximate to the nip point 14 on the leading side of the nip point 14, i.e., the side where the batt 11 will traverse prior to being compressed by the nip point 14. The posterior passage 41 is shaped to open into the drum 31 between the core 32 and the exterior surface 33 on the opposite side of the drum 31 from the nip point 14, i.e., the posterior side of the drum 31. An anterior duct 42 connects to the anterior passage 37, and a posterior duct 43 connects to the posterior passage 41. Though not illustrated in FIG. 3, and illustrated only schematically in FIG. 1, portions of the ducts 42 and 43 are preferably incorporated into the housing 22, but this is not necessary to the proper functioning of the invention.

Similarly, but illustrated only schematically in FIG. 1, at least one of, but preferably both the first side 26 and the second side 27 (not shown in FIG. 1) of the housing 23 of the suspended unit 60 are pierced by an anterior passage 67 and a posterior passage 69. The anterior passage 67 is shaped to open into the upper drum 61 between the core 62 and the exterior surface 63 about and before the nip point 14, i.e., the anterior side of drum 61. The posterior passage 69 is shaped to open into the drum 61 between the core 62 and the exterior surface 63 on the opposite side of the drum 61 from the nip point 14, i.e., the posterior side of drum 61. An anterior duct 72 connects to the anterior passage 67, and a posterior duct 70 connects to the posterior passage 69. As illustrated, in a preferred embodiment portions of the ducts 72 and 70 are incorporated into the housing 23, such as by ducting 73 and 71 which lead from ducts 72 and 70, respectively, to passages 67 and 69. Alternate configurations of ducting are within the contemplation of the present invention.

Figure 4:
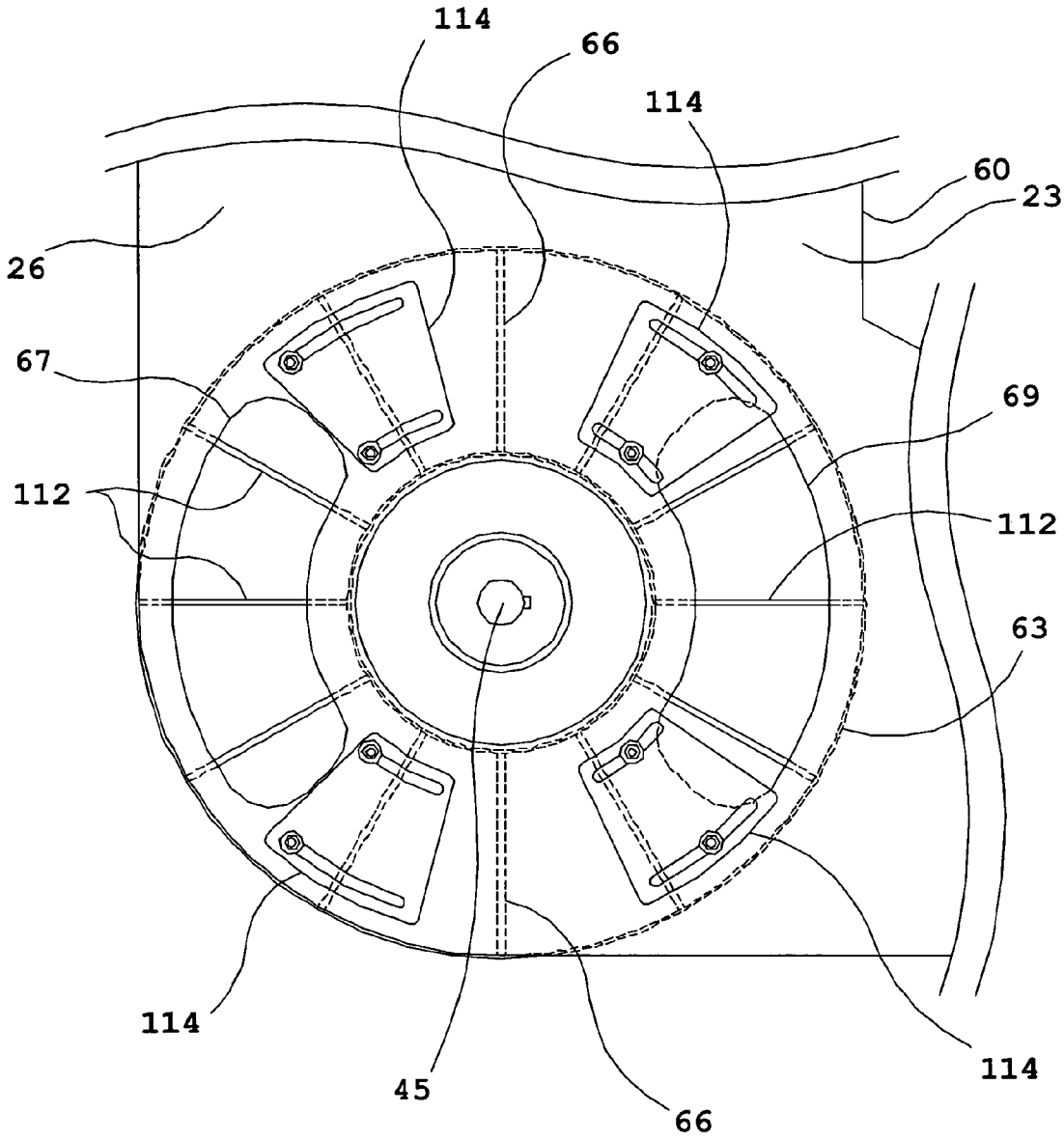
FIG. 4 is a partial side exterior view of a side of the housing of the suspended unit of the present invention without any ducting attached to the anterior passage or posterior passage.

In a preferred embodiment of the present invention, it has been found advantageous to provide a means for varying the size of the anterior and posterior passages 37, 41, 67, 69 of both the lower and upper drums 31, 61. Varying the size of the passages 37, 41, 67, 69 allows for the airflow to be more precisely directed into the compartments 35, 65 of the drums 31, 61 as well as increasing and decreasing the rate of the airflow. For example, by directing the flow of air primarily into the compartments 35, 36 as they rotate towards the nip point 14, the flow of hot moist air can be directed primarily through the batt 11 before it is compressed by the nip point 11, thereby increasing the efficiency of the dispersion of moisture throughout the width of the batt 11. FIG. 4 shows a partial side exterior view of a first side 26 of the housing 23 of the suspended unit 60 without any ducting (not shown) attached to the anterior passage 67 or posterior passage 69. The exterior surface 63, core 62 and staves 66 of drum 61 are illustrated by dashed lines indicating they are behind the side 26 of the housing 23, except for a visible portion 112 of several of the staves 66 that are passing the anterior and posterior passages 67, 69. One means for varying the size of the anterior and posterior passages 37, 41, 67, 69 is to associate one or more slidable baffles 114 with each passage 37, 41, 67, 69 that may be positioned over all or a portion of the associated passage 37, 41, 67, 69. Baffles 114 may be attached on the inside or outside of the housing 23, or, in one preferred embodiment, may be incorporated internally within a cavity (not shown) inside the side 26 of the housing 23.

Returning, then, to FIG. 1, the stationary unit 30 further comprises opposing upper and lower sets of a plurality of rows of replaceable flashing 38, 39 extending from the housing 22 to engage and form a seal with the exterior surface 33 of the lower drum 31. Flashing 38, 39 runs from the first side 24 to the second side 25 of the housing 22, engaging the exterior surface 33 of the drum 31 substantially along its entire length. The upper set of flashing 38 engages the exterior surface 33 of the lower drum 31 as the surface 33 rotates from the posterior passage 41 towards the anterior passage 37. The lower set of flashing 39 engages the exterior surface 33 of drum 31 as the surface 33 rotates from the anterior passage 37 towards the posterior passage 41. Thus it can be seen that the opposing sets of flashing 38, 39 serve to create and separate an anterior air chamber 107 and a posterior air chamber 108 on the anterior and posterior sides of the drum 31. The opposing sets of flashing 38, 39 function as a means to substantially prevent air from migrating from the anterior air chamber 107 to the posterior air chamber 108 or vice versa. Because the drum 31 is rotating when in operation, a certain amount of air contained within the compartments 35 of the drum 31 may be carried from the anterior air chamber 107 to the posterior air chamber 108 and vice versa, but this nominal migration of air is not sufficient to interrupt the directions of the airflows in each chamber 107, 108 that are created as described below in connection with FIG. 2.

The preferred number of flashings 38, 39 used in each set and their positioning relative to each other depend upon several variables such as the radius of the drum 31, the number of staves 36, length of flashings 38, 39 and the anticipated rotational velocity of the drum 31. The number and positioning of rows of flashings 38, 39 within each set should be varied as necessary in order to minimize or prevent altogether the instances where a continuous channel from one air chamber 107 to the other 108 is created as the drum 31 rotates.

The housing 22 further comprises an exit passage 56 through the housing 22 into the posterior air chamber 108. Ducting 54 may be connected to the exit passage 56.

Figure 2:
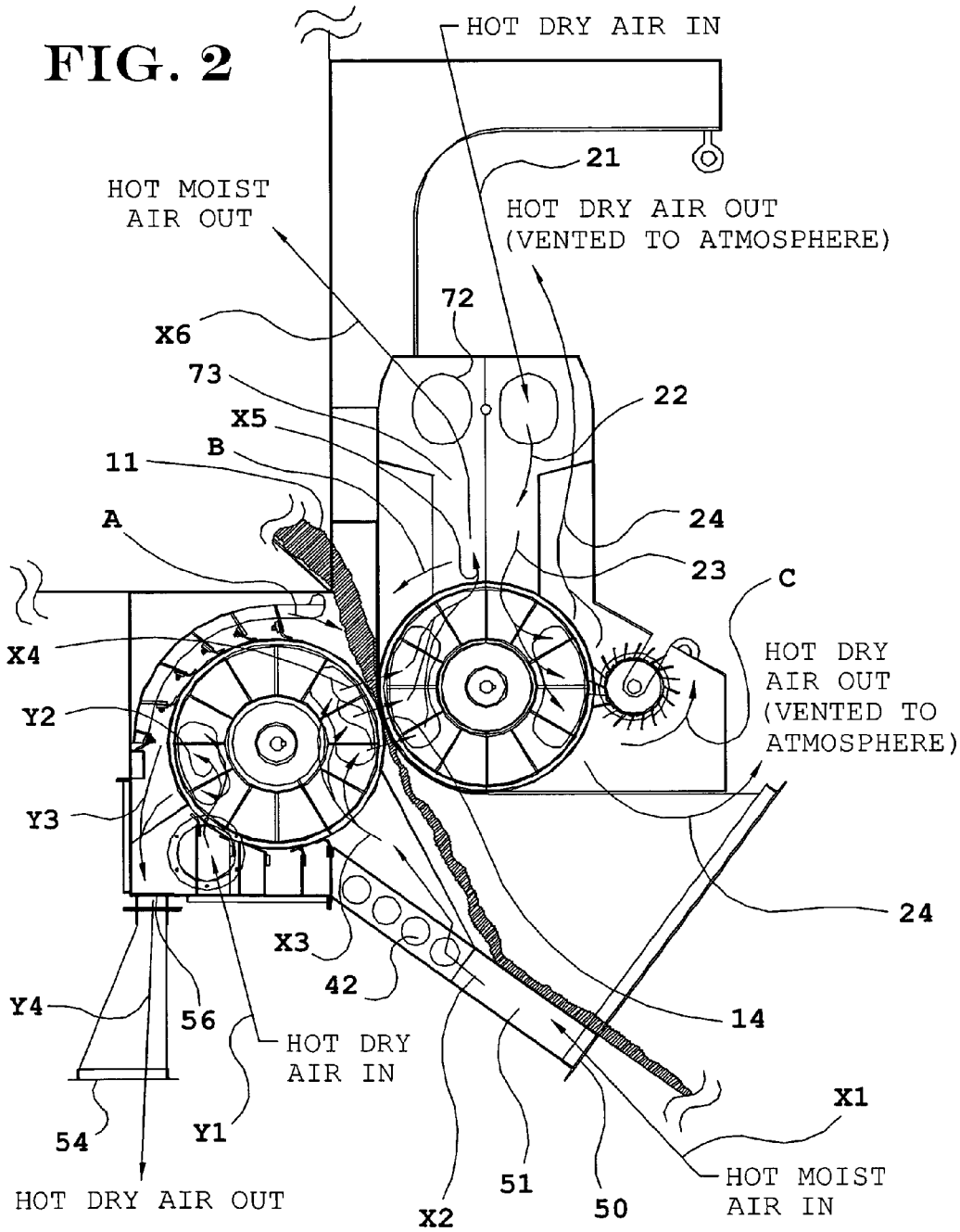
FIG. 2 is a side schematic view of the cotton conditioning device of the present invention showing the airflow routes.

Referring now to FIG. 2, a side schematic view of the drum rotation and airflow routes through the cotton conditioning device 10 is shown. When the suspended unit 60 is put into position, its mating surface 29 substantially mates with the mating surface 28 of the stationary unit, thus forming the complete conditioning device 10. One or more motors (not shown) rotate the drums 31, 61 and the doffing roller 83 at the desired speeds. The lower drum 31 rotates in the direction indicated by arrow A, opposite the rotation of the upper drum 63, the direction of which is indicated by arrow B. Doffing roller 83 also rotates in the same direction as the upper drum 62 as indicated by arrow C.

When the complete conditioning device 10 is formed, the three airflow channels illustrated schematically by arrows X, Y and Z in FIG. 2 are formed. Any manner and configuration of ducting and fans may be utilized to create an air pressure gradient through each of the channels that will cause properly conditioned air to flow in the desired direction through the three airflow channels of the conditioning device 10. Similarly, any of the known methods of conditioning the air (i.e., heating, adding moisture, etc.) that will travel through the three airflow channels of the conditioning device 10 may be utilized in connection with the present invention.

A primary conditioning channel (illustrated by arrows X1-X6) is formed to direct hot, moist air through the batt 11 as it passes about the nip point 14 between the counter-rotating lower drum 31 and upper drum 61. Specifically, air flowing through the primary conditioning channel is blown or drawn, or both, but preferably at least drawn, from a hot, moist air source (not shown) through ducting 50, 51, 42 (arrows X1 and X2), through anterior passage 37 (arrows X3) into one or more of compartments 35 of the lower drum 31 as said compartments rotate past anterior passage 37, through the perforated surface 33 of the lower drum 31 (arrows X4) through the perforated surface 63 of the upper drum 61, into one or more of compartments 65 of the upper drum 61 as said compartments rotate past anterior passage 67, through anterior passage 67 (arrow X5) and on through ducting 73, 72 (arrow X6), eventually to a bank of cyclones (not shown) to remove particulate matter from the air, and eventually to an exhaust (not shown). Preferably, the negative air pressure generated by one or more pull fans at the exhaust end of the primary conditioning channel is greater than the positive air pressure generated by any pushing fans that push or inject air into the primary conditioning channel to ensure the proper draw or pressure gradient of hot, moist air across the batt 11 through the primary conditioning channel.

Due to the rotation of the drums 31, 61, each open-ended compartment 35, 65 only periodically comprises a portion of the primary conditioning channel as it rotates past (or adjacent to) the anterior passage 37, 67. When a portion of an compartment 35, 65 is beside an anterior passage 37, 67, a continuous channel is opened allowing the flow of air described above. When a portion of a compartment 35, 65 is not beside an anterior passage 37, 67, there is no draw of air through the compartment 35, 65 unless the compartment 35, 65 is beside the posterior passage 41, 69 of that respective drum 31, 61, at which point the compartment 35, 65 forms a portion of one of the other two airflow channels of the conditioning device 10 as described below.

Thus it can be seen that due to the positioning of the anterior passages 37, 67 about, and preferably tending towards the side of the nip point 14 where the batt 11 is approaching the nip point 14 before being compressed, when a batt 11 is moving towards and through the nip point 14 between counter-rotating drums 31 and 61, the hot, moist air is drawn through the batt 11 from the compartments 35 of the lower drum 31 and into the compartments 65 of the upper drum 61, thereby adding moisture in a substantially uniform manner to the entire width and breadth of the batt 11. The draw of air through the anterior passage 67 of the upper drum 61 must be of sufficient strength to create a draw through the anterior passage 37 of the lower drum 31 despite the potential leakage of some air into the anterior air chamber 107. To the extent that hot, moist air might flow into the anterior air chamber 107 from the compartments 35 of the lower drum 31 prior to being drawn through the batt 11 and into the compartments 65 of the upper drum 61, the anterior air chamber 107 may be considered a portion of the primary conditioning channel.

Using the cotton conditioning device 10 of the present invention, one is able to control the moisture content of the batt 11 by adjusting the amount of moisture in the flow of hot, moist air at its source, or by adjusting the speed at which the batt 11 transverses the conditioning device 10, or by adjusting the pressure gradient or speed at which the hot moist air moves through the primary conditioning channel. For example, the moisture content of the hot moist air may need to be adjusted to account for the amount of moisture already existing in the air of that particular locality and/or the amount of moisture desired in the batt 11. One or more conventional sensing devices can be added to detect the moisture content of the lint cotton either before or after passing through the conditioning device 10 and alert the user to make necessary adjustments. This adjustment could also be made automatically with electronic controls connected to the sensing devices.

In a preferred embodiment, it has been found useful to utilize the hot, moist air traveling to the anterior passage 37 to heat the underside of slide 76 before drawing it through ducting 50, 51 and 42 to anterior passage 37.

Because of the moisture being pulled through the drums 31, 61 as part of the primary conditioning channel, in order to avoid the accumulation of condensation and lint on the exterior perforated surfaces 33, 63, cores 32, 62 and staves 36, 66 of the drums 31, 61, it is desirable to dry these surfaces during operation. The other two airflow channels (illustrated by arrows Y and Z) carry hot, dry air through the conditioning device 10 to dry the exterior perforated surfaces 33, 63, cores 32, 62 and staves 36, 66 of the drums 31, 61.

A first drying channel (illustrated by arrows Y1-Y4) is formed to direct hot, dry air along a pressure gradient through the posterior side of drum 31. Specifically, air flowing through the first drying channel is blown or drawn, or both, but preferably at least drawn, from a hot, dry air source (not shown) through posterior duct 43 (arrow Y1), through posterior passage 41 (arrows Y2) into one or more of compartments 35 of the lower drum 31 as said compartments rotate past posterior passage 41, through the perforated surface 33 of the lower drum 31 into posterior air chamber 108 (arrows Y3) and on through exit duct 56 (arrow Y4) and any associated ducting 54.

Due to the rotation of the drum 31, each compartment 35 only periodically comprises a portion of the first drying channel as it rotates past the posterior passage 41. When a portion of a compartment 35 is beside the posterior passage 41, a continuous channel is opened allowing the flow of air described above.

Though it is possible that the direction of the air flow through the first drying channel might be reversed from the flow just described, this is less preferable because the action of air blowing in through the perforated surface 33 would tend to carry lent into the compartments 35 of the drum 31 where it might accumulate, resulting in an accelerated need to clean the conditioning device 10. Conversely, by using the preferred airflow through the first drying channel, air blowing from inside the compartments 35 out through the perforated surface 33 assists in keeping the perforations from becoming clogged with lint.

A second drying channel (illustrated by arrows Z1-Z4) is formed to direct hot, dry through the posterior side of drum 61 in order to dry the exterior perforated surface 63, core 62, and staves 66 of drum 61. Specifically, air flowing through the second drying channel is blown or drawn, or both, but preferably at least blown, from a hot, dry air source (not shown) through posterior duct 70 (arrow Z1), through ducting 71 (arrow Z2), then through posterior passage 69 (arrow Z3) of upper drum 61 into one or more of compartments 65 of the upper drum 61 as said compartments 65 rotate past posterior passage 69, through and away from the perforated surface 63 of drum 61. In the illustrated preferred embodiment, the posterior side of upper drum 61 comprises an unsealed compartment that is open to the atmosphere, allowing the hot, dry air to be pushed away out of any available opening, such as along the lines illustrated as arrows Z4. If desired, additional exhaust ducting or hooding (not shown) could be added to carry the air away from the second drying channel after it exits the perforated surface 63 of drum 61.

Due to the rotation of the drum 61, each open-ended compartment 65 only periodically comprises a portion of the second drying channel as it rotates past the posterior passage 69. When a portion of a compartment 65 is beside the posterior passage 69, a continuous channel is opened, allowing the flow of air described above.

Where each of the first drying channel and second drying channel ultimately exits or is vented to the atmosphere, it may also be desirable to employ any of the known means to control condensation that may form on surfaces as the hot, dry air carries moisture away from the drums 31, 61.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, I claim:

1. A device for humidifying and compressing a batt of fibrous material comprising:

(a) a rotating first drum adjacent a counter-rotating second drum, the first drum and the second drum forming a nip point for compressing and passing the batt;

(b) the first drum having opposing ends, a perforated exterior surface and being internally divided into a plurality of open-ended compartments, the first drum being enclosed on both ends by a plurality of solid sides, at least one of said solid sides enclosing the first drum having an anterior passage positioned about the nip point for allowing the flow of air through the solid side into the compartments of the first drum as said compartments of the first drum rotate adjacent said anterior passage;

(c) the second drum having opposing ends, a perforated exterior surface and being internally divided into a plurality of open-ended compartments, the second drum being enclosed on both ends by a plurality of solid sides, at least one of said solid sides enclosing the second drum having an anterior passage positioned about the nip point for allowing the flow of air from inside the compartments of the second drum through the solid side enclosing said second drum as said compartments of the second drum rotate adjacent said anterior passage; and (d) at least one fan for creating a flow of moist air through the anterior passage of said solid side enclosing the first drum into the compartments of the first drum as the compartments of the first drum rotate adjacent the anterior passage of said solid side enclosing the first drum, out of the compartments of the first drum through the perforated surface of the first drum across the nip point and through the perforated surface of the second drum into the compartments of the second drum as the compartments of the second drum rotate adjacent the anterior passage of said solid side enclosing the second drum and out of the compartments of the second drum through the anterior passage of said solid side enclosing the second drum thereby humidifying a batt as it traverses in the proximity of the nip point.

2. The device of claim 1 further comprising a housing defining an enclosure for the first drum and the second drum, said housing having an opening for receiving said batt and an output opening through which the ball advances after conditioning.

3. The device of claim 2 wherein said housing further comprises:

(a) a stationary unit defining an enclosure for the first drum, said stationary unit comprising the solid sides enclosing the first drum, each of said solid sides enclosing the first drum further comprising a mating surface, said stationary unit being substantially open between the mating surfaces of said solid sides enclosing the first drum; and (b) a suspended unit defining an enclosure for the second drum, said suspended unit comprising the solid sides enclosing the second drum, each of said solid sides enclosing the second drum further comprising a mating surface shaped to correspond to a mating surface of the stationary unit, said suspended unit being substantially open between the mating surfaces of said solid stationary sides enclosing the second drum; and (c) wherein the mating surfaces of the suspended unit are engaged against the corresponding mating surfaces of the stationary unit.

4. The device of claim 1 wherein one of said first and second counter-rotating drums is slightly elevated relative to the other.

5. The device of claim 1 further comprising:

(a) at least one of said solid sides enclosing the first drum having a posterior passage opening into the compartments of said first drum on the opposite side of said first drum from the nip point; and (b) at least one fan connected to the posterior passage for creating a flow of hot dry air through the solid side enclosing the first drum into the compartments of the first drum as the compartments of the first drum rotate adjacent the posterior passage and out of the compartments of the first drum through the perforated surface of the first drum.

6. The device of claim 1 further comprising:

(a) at least one of the solid sides enclosing the second drum having a posterior passage opening into the compartments of the second drum on the opposite side of the second drum from the nip point; and (b) at least one fan connected to the posterior passage for creating a flow of hot dry air through the solid side enclosing the second drum into the compartments of the second drum as the compartments of the second drum rotate adjacent the posterior passage and out of the compartments of the second drum through the perforated surface of the second drum.

7. The device of claim 3 wherein the stationary unit further comprises a posterior air chamber defined by a portion of the housing, an upper plurality of rows of replaceable flashing extending from the housing to engage and form a substantially lengthwise seal with the perforated exterior surface of the first drum, and a lower plurality of rows of replaceable flashing extending from the housing to engage and form a substantially lengthwise seal with the perforated exterior surface of the first drum.

8. The device of claim 7 further comprising (a) at least one of the solid stationary sides enclosing the first drum having a posterior passage opening into the compartments of the first drum on the opposite side of the first drum from the nip point, (b) the housing having an exit passage opening into the posterior air chamber, and (c) at least one fan connected to the posterior passage for creating a flow of hot dry air through the solid side enclosing the first drum into the compartments of the first drum as the compartments of the first drum rotate adjacent the posterior passage, out of the compartments of the first drum through the perforated surface of the first drum into the posterior air chamber and through the exit passage.

9. The device of claim 3 wherein the corresponding mating surfaces of the stationary unit and of the suspended unit have a curvature substantially following the curvature of the perforated exterior surface of the second drum.

10. The device of claim 1 further comprising a rotatable doffing roller adjustably positionable adjacent one or more of said drums.

11. The device of claim 3 further comprising a laterally transverse shaft axially aligned with the second drum from which the suspended unit is pivotably suspended.

12. The device of claim 11 further comprising one or more pistons attached to the suspended unit for controlling the movement of the suspended unit relative to the stationary unit.

13. The device of claim 1 wherein each of said drums further comprise a core connected to a shaft, the perforated exterior surface being connected to the core by connection to a plurality of radial staves extending from the core, said staves having substantially the same length as the core, said shaft extending at least to the solid sides of the housing and being operationally connected to a motor for powering and controlling the rotational speed of the drum.

14. The device of claim 13 wherein the core, staves and perforated exterior surface at both ends of each drum have a plurality of replaceable gaskets to provide a seal against the solid sides of the housing.

15. The device of claim 13 wherein the perforated exterior surface of said first drum is releasably connected to the staves of said first drum, and wherein the perforated exterior surface of said second drum is releasably connected to the staves of said second drum.

16. The device of claim 1 further comprising means for varying the size of the anterior passage of the solid side enclosing the first drum and means for varying the size of the anterior passage of the solid side enclosing the second drum.

17. The device of claim 5 further comprising means for varying the size of said posterior passage opening into the compartments of said first drum.

18. The device of claim 6 further comprising means for varying the size of said posterior passage opening into the compartments of said second drum.

19. A device for humidifying a batt of fibrous material comprising a primary conditioning channel for carrying moist air along a pressure gradient, said primary conditioning channel comprising:

(a) an anterior passage through at least one of a pair of opposing sides of a housing positioned to enclose both ends of a first rotatable drum, said first rotatable drum having a plurality of open-ended internal longitudinal compartments and a perforated exterior surface;

(b) at least one compartment of said first rotatable drum as said compartment rotates adjacent said anterior passage;

(c) a plurality of perforations in a segment of the exterior surface of the first rotatable drum over the compartment as it rotates adjacent said anterior passage;

(d) a gap of between about one quarter inch to about one inch between the exterior surface of the first rotatable drum and a perforated exterior surface of a second rotatable drum aligned with the first rotatable drum, said second rotatable drum having a plurality of open-ended internal longitudinal compartments;

(e) a plurality of perforations in a segment of the exterior surface of the second rotatable drum over a compartment of the second rotatable drum as the compartment rotates adjacent a second-drum anterior passage through at least one of a pair of opposing sides of a housing positioned to enclose both ends of the second rotatable drum;

(f) at least, one compartment of the second rotatable drum as it rotates adjacent the second-drum anterior passage; and (g) the second-drum anterior passage;

(h) wherein the batt is advanced through the gap between the first and second rotatable drums as said drums rotate in opposite directions and the pressure gradient through the primary conditioning channel is created by means of one or more fans connected to said primary conditioning channel.

20. The device of claim 19 further comprising a first drying channel for carrying hot dry air along a pressure gradient, said first drying channel comprising:

(a) a posterior passage through at least one of the pair of opposing sides of the housing enclosing the first rotatable drum;

(b) at least one compartment of said first rotatable drum as said compartment rotates adjacent said posterior passage;

(c) a plurality of perforations in a segment of the exterior surface of said first rotatable drum over the compartment as it rotates adjacent said posterior passage;

(d) a posterior air chamber defined by a portion of the housing, an upper plurality of rows of replaceable flashing extending from the housing to engage and form a substantially lengthwise seal with the perforated exterior surface of the first rotatable drum, and a lower plurality of rows of replaceable flashing extending from the housing to engage and form a substantially lengthwise seal with the perforated exterior surface of the first rotatable drum; and (e) an exit passage through said housing into the posterior air chamber;

(f) wherein the pressure gradient through the first drying channel is created by means of one or more fans connected to said first drying channel.

21. The device of claim 19 further comprising a second drying channel for carrying hot dry air along a pressure gradient, said second drying channel comprising:

(a) a posterior passage through at least one of the pair of opposing sides of the housing enclosing the second rotatable drum;

(b) at least one compartment of said second rotatable drum as said compartment rotates adjacent said posterior passage;

(c) a plurality of perforations in a segment of the exterior surface of said second rotatable drum over the compartment as it rotates adjacent said posterior passage; and (d) an output opening through said housing;

(e) wherein the pressure gradient through the second drying channel is created by means of one or more fans connected to said second drying channel 19.

22. The device of claim 19 further comprising means for varying the size of one or more of said anterior passages.

23. The device of claim 20 further comprising means for varying the size of said posterior passage.

24. The device of claim 21 further comprising means for varying the size of said posterior passage.

25. A device for humidifying and compressing a batt of fibrous material comprising:

(a) a housing having an opening for receiving said batt and an output opening for outputting said batt after humidification and compression;

(b) said housing further comprising:

(i) a stationary unit having at least first and second opposing sides, each of said first and second opposing sides further comprising a mating surface, said mating surfaces of said first and second opposing sides defining an opening in the stationary unit between said first and second opposing sides;

(ii) a suspended unit having at least first and second opposing sides, each of said first and second opposing sides further comprising a mating surface shaped to engage with the corresponding mating surface of the stationary unit, said mating surfaces of said first and second opposing sides defining an opening in the suspended unit between said first and second opposing sides; and (iii) a shaft from which the suspended unit is suspended to pivotably engage with the stationary unit;

(c) a cylindrical, rotatable first drum on an axial shaft, said shaft running from the first opposing side of the stationary unit, through a first opposing end of said first drum, to a second opposing end of said first drum, to the opposing second side of the stationary unit, said first drum having a perforated exterior surface and being internally divided into a plurality of open-ended compartments by a plurality of radial staves extending from the shaft to the perforated exterior surface, said staves running axially along the shaft from about the first opposing end of said first drum to about the second opposing end of said first drum, and wherein the first opposing end of the first drum is substantially covered by the first side of the stationary unit and the second opposing end of the first drum is substantially covered by the second side of the stationary unit;

(d) a cylindrical, rotatable second drum on an axial shaft, said shaft running from the first opposing side of the suspended unit, through a first opposing end of said second drum, to a second opposing end of said second drum, to the opposing second side of the suspended unit, said second drum having a perforated exterior surface and being internally divided into a plurality of open-ended compartments by a plurality of radial staves extending from the shaft to the perforated exterior surface, said staves running axially along the shaft from about the first opposing end of said second drum to about the second opposing end of said second drum, and wherein the first opposing end of the second drum is substantially covered by the first side of the suspended unit and the second opposing end of the second drum is substantially covered by the second side of the suspended unit;

(e) said first and second drums forming a nip point for compressing and passing the batt when the suspended unit is engaged with the stationary unit;

(f) one or more motors operatively connected to rotate said first and second drums in opposite directions;

(g) at least one anterior passage in one or more of the opposing sides of the stationary unit, said anterior passage positioned to open into one or more of the opposing ends of the first drum about the nip point;

(h) at least one second-drum anterior passage in one or more of the opposing sides of the suspended unit, said second-drum anterior passage positioned to open into one or more of the opposing ends of the second drum about the nip point; and (i) at least one fan connected to either of said anterior passages for creating a flow of moist air through a primary conditioning channel, said primary conditioning channel comprising: (i) said anterior passage of the stationary unit, (ii) at least one of the compartments of the first drum as said compartment of the first drum rotate adjacent the anterior passage of the stationary unit, (iii) a plurality of perforations in a segment of the exterior surface of the first drum over said compartment of the first drum, (iv) the nip point, (v) a plurality of perforations in a segment of the exterior surface of the second drum, said segment covering at least one of the compartments of the second drum as said compartment of the second drum rotates adjacent said second-drum anterior passage of the suspended unit, (vi) at least one of the compartments of the second drum as said compartment of the second drum rotates adjacent said second-drum anterior passage of the suspended unit, and (vii) said second-drum anterior passage of the suspended unit.

26. The device of claim 25 further comprising:

(a) at least one posterior passage in one or more of the opposing sides of the stationary unit, said posterior passage positioned to open into one or more of the opposing ends of the first drum opposite the anterior passage of said first drum; and (b) at least one fan connected to said posterior passage for creating a flow of hot dry air through the posterior passage, into the compartments of the first drum as the compartments of the first drum rotate adjacent said posterior passage and out of the compartments of the first drum through the perforated surface of the first drum.

27. The device of claim 26 further comprising a posterior air chamber defined by a portion of the stationary unit, an upper plurality of rows of replaceable flashing extending from the stationary unit to engage and form a substantially lengthwise seal with the perforated exterior surface of the first drum, and a lower plurality of rows of replaceable flashing extending from the housing to engage and form a substantially lengthwise seal with the perforated exterior surface of the first drum, said posterior air chamber further comprising an exit passage through said portion of the stationary unit.

28. The device of claim 25 further comprising:

(a) at least one posterior passage in one or more of the opposing sides of the suspended unit, said posterior passage positioned to open into one or more of the opposing ends of the second drum opposite the anterior passage of said second drum; and (b) at least one fan connected to said posterior passage for creating a flow of hot dry air through the posterior passage, into the compartments of the second drum as the compartments of the second drum rotate adjacent said posterior passage and out of the compartments of the second drum through the perforated surface of the second drum.

29. The device of claim 25 wherein said first drum further comprises a core attached about the shaft of said first drum, and wherein the radial staves of said first drum extend from said core to the perforated exterior surface of said first drum.

30. The device of claim 25 wherein said second drum further comprises a core attached about the shaft of said second drum, and wherein the radial staves of said second drum extend from said core to the perforated exterior surface of said second drum.

31. The device of claim 25 wherein one of said first and second drums is slightly elevated relative to the other.

32. The device of claim 25 further comprising a rotatable doffing roller adjustably positionable adjacent one or more of said drums.

33. The device of claim 25 further comprising one or more pistons attached to the suspended unit for controlling the movement of the suspended unit relative to the stationary unit.

34. The device of claim 25 further comprising means for varying the size of said anterior passages.

35. The device of claim 26 further comprising means for varying the size of said posterior passage.

36. The device of claim 28 further comprising means for varying the size of said posterior passage.

* * * * *